United States Patent [19]

Pensa

[11] Patent Number: 4,927,335

[45] Date of Patent: May 22, 1990

[54] PUMP FOR TRANSFERRING LIQUIDS, IN PARTICULAR BEER OR CARBONATED BEVERAGES

[75] Inventor: Carlo M. Pensa, Esino Lario, Italy

[73] Assignee: O.D.L. S.r.l., Como, Italy

[21] Appl. No.: 264,264

[22] Filed: Oct. 28, 1988

[30] Foreign Application Priority Data

Nov. 4, 1987 [IT] Italy ..... 22509 A/87

[51] Int. Cl.[5] ..... F04B 43/06

[52] U.S. Cl. ..... 417/393

[58] Field of Search ..... 417/393, 397, 396, 401, 417/403, 404

[56] References Cited

U.S. PATENT DOCUMENTS 4,674,958 6/1987 Igarashi et al. ..... 417/393

FOREIGN PATENT DOCUMENTS 132913 2/1985 European Pat. Off. ..... 417/393

*Primary Examiner*—Leonard E. Smith

*Attorney, Agent, or Firm*—Parmelee, Bollinger & Bramblett

[57] ABSTRACT

The present invention relates to a pump for transferring liquids, in particular for beer or carbonated beverages, characterized in that it is constituted by two mutually opposite and integral pistons sliding inside two cylinders which generate, with their reciprocating motion, four variable-volume chambers inside two of which the fluid, through suitable valves, is alternatively intaken and delivered by a gas whose pressure is modulated by a suitable pressure regulator, in which it is the pressure of the same delivered liquid to counteract the calibration force, with said gas alternatively going to act, by means of suitable control means, inside the chamber behind the delivery chamber, so that the delivery pressure of the same liquid remains constant and predetermined, wherein said delivery pressure is obtained as the sum of the thrust of the liquid intaken from the opposite chamber, plus the modulated gas pressure, which acts on the rear face of the delivery piston.

6 Claims, 2 Drawing Sheets

PUMP FOR TRANSFERRING LIQUIDS, IN PARTICULAR BEER OR CARBONATED BEVERAGES

The facilities for tapping beer or other beverages are well-known apparatuses, which are constituted by a drum for the transport of the beverage, equipped with connection valves, a fitting which is connected to said valves and makes it possible for the driving gas, usually $CO_2$ or nitrogen, to enter the drum, and the exiting of the beverage, which is delivered to the pouring-out stopcock, after being possibly refrigerated.

The thrust applied to the gas usually performs the double task of maintaining at the correct value the saturation pressure of the gas in the beverage (with such a pressure being variable with varying temperature of the same beverage), and of driving the same liquid, over even very long distances: in fact, the present trend is of storing the beverage-containing drums inside the cellar, wherein larger rooms are available, and the temperature is more suitable for the preservation of the same beverage, whilst the delivery takes place at the upper floor, or sometimes at the highest storeys of the building. Therefore, whilst at lower temperatures the liquid should have a low saturation pressure, such pressures should be increased in order to overcome the pressure drops due to the difference in height, to the distance and to the cooling coils. The consequence thereof is an over-carbonation of beer, with the consequent formation of foam at the delivery time, and with the pouring out becoming impossible.

All the systems proposed to date, with the insertion of pumps and of control systems have led to complex results, with high consumptions of electrical power, difficulties of management, nor did they completely solve the problem of the constance in the thrust applied to the same liquid.

The present invention solves the above exposed problem in a simple and very efficacious way.

DETAIL DESCRIPTION OF THE INVENTION

Figure 1:
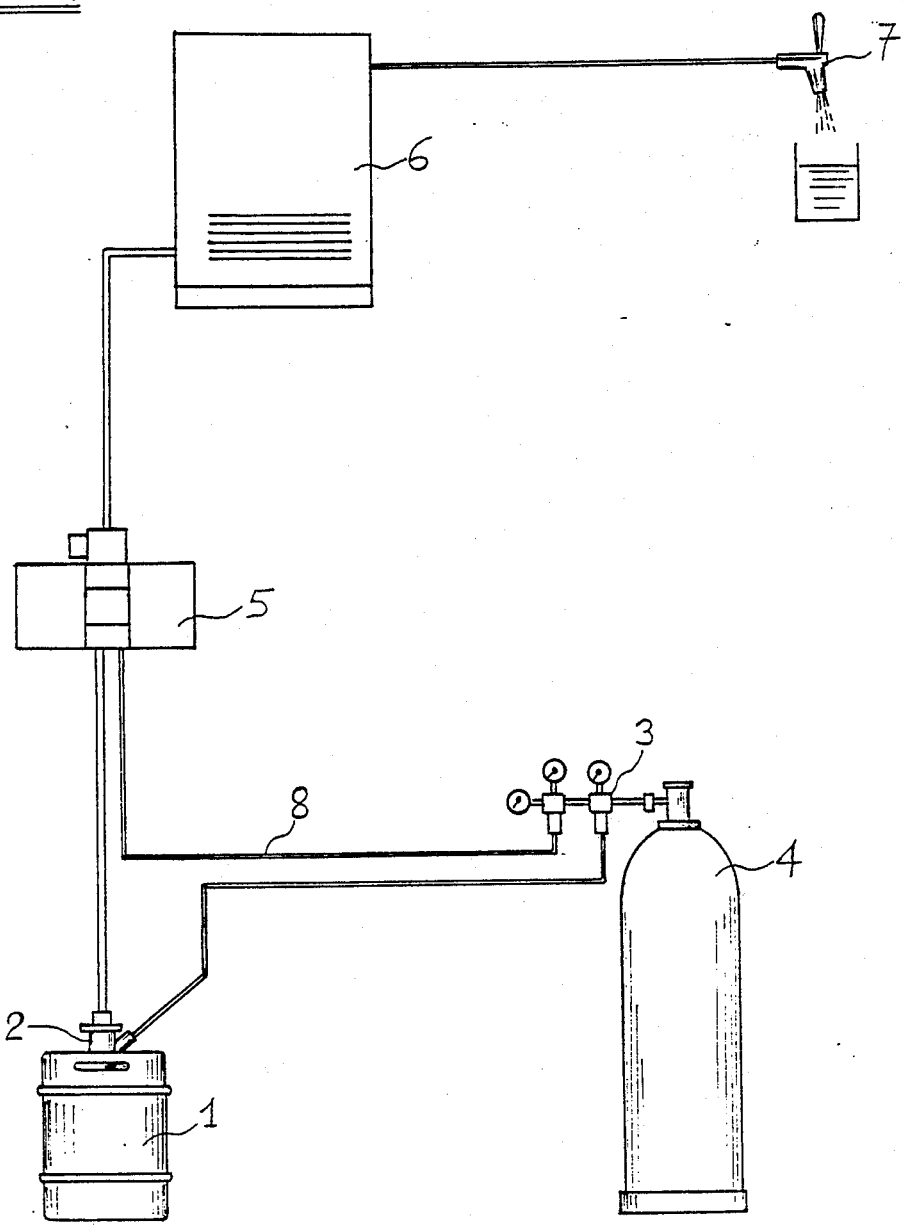
FIG. 1 shows a general diagram of an apparatus for the delivery of a beverage.

FIG. 1 shows the general diagram of the facility: by the reference numeral 1, the drum is indicated, with the relevant systems 2 of valves and fitting, which make it possible for the gas which is supplied by the reducer 3 mounted on the gas cylinder 4, to enter the system and beer to exit, wherein said beer is conveyed to the pump 5, which is the subject-matter of the instant invention; from this pump 5, beer goes to the refrigerator 6, and subsequently to the pouring out stopcock 7.

To the pump 5, a pressure line 8 furthermore comes, which arrives from the second body of the reducer 3.

Clearly, whilst the thrust generated by $CO_2$ inside the drum will be regulated in such a way as to achieve the ideal value for the optimization of the product, wherein said regulation can either be carried out by means of a manual adjustment, or can take place by means of suitable automatic systems, the gas pressure at the pump, through the line 8 will have, on the contrary, such a value as to secure the operation of the pump 5.

Figure 2:
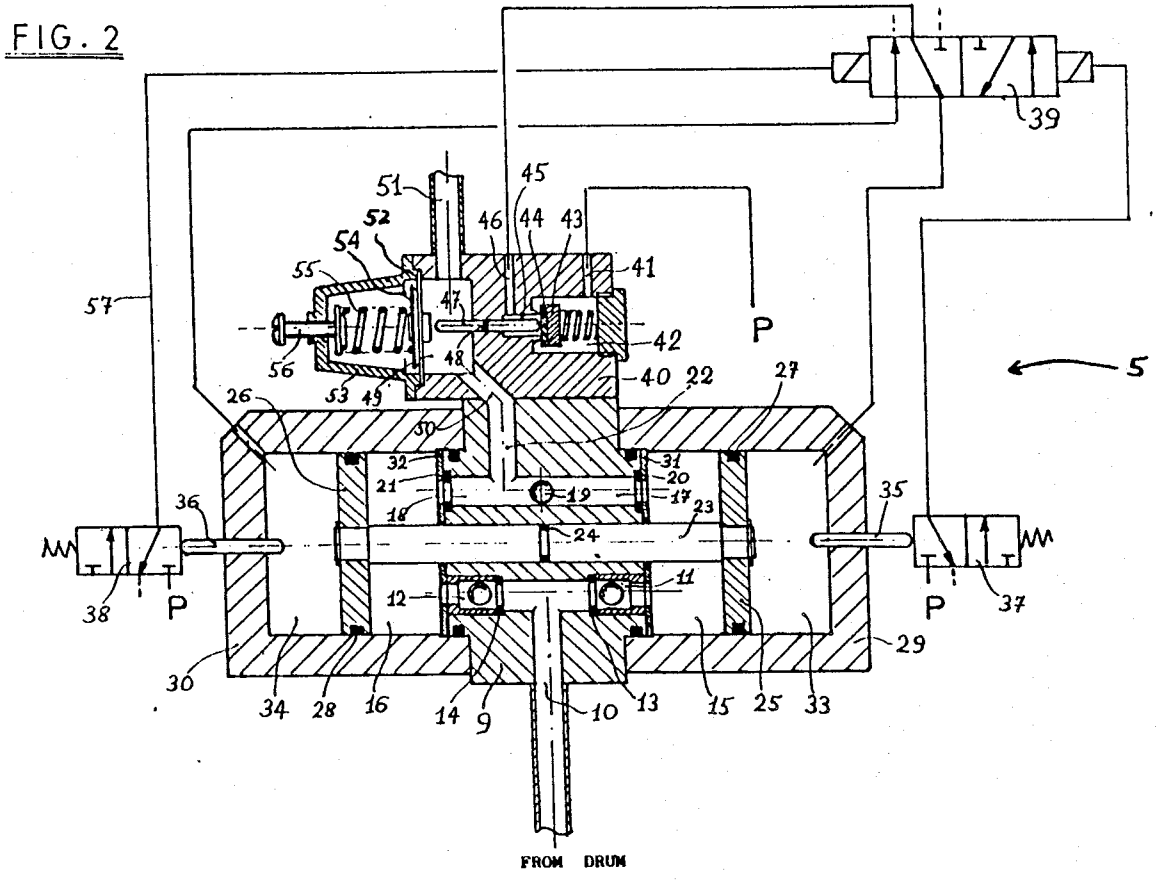
FIG. 2 shows details of a pump for beverages.

In FIG. 2, an example of a possible solution for the pump, which is the subject-matter of the present invention, is schematically shown; by the reference numeral 9, the central body is indicated, wherein the inlet duct 10 for beer is provided; said beer inlet duct 10 branches into two conduits, in order to lead, through the non-return valves 11 and 12, acting on the gaskets 13 and 14, to the two pumping chambers 15 and 16; from said chambers the delivery conduits 17 and 18 branch off, with the ball valve 19 acting on the gaskets 20 and 21; said conduits 17 and 18 merge to form the delivery duct 22.

Inside the pump body, the rod 23 slides with its gasket 24; said rod 23 bears the two integral pistons 25 and 26 with the relevant gaskets 27 and 28; said pistons slide inside the cylinders 29 and 30 centered with the body by the keying with the gaskets 31 and 32, and fastened by means of screws, not shown in the figure.

Inside said cylinder, the chambers 33 and 34 are therefore formed, which are opposite to the chambers 15 and 16; on the bottom of the said chambers 33 and 34, two sensor elements 35 and 36 are installed with tight sealing, which control three-way pneumatic valves 37 and 38. Clearly, said valves can be provided inside the cover, and be connected, by means of suitable conduits provided inside said cover, to the pipe leading to the working gas source; or, without limiting in any way the invention, they can be installed outside the same cover.

In the hereto attached figure, said valves are indicated with their pneumatic symbology, as well as indicated is the five-way, bistable, pneumatic-drive valve 39 controlled by said sensors. This latter valve 39 distributes the control pressure modulated by the regulator 40 to both chambers 33 and 34.

Inside the regulator 40, the drive pressure p arrives from the line 8 of FIG. 1, through the inlet 41, to the chamber 42, wherein the shutter 43 is housed, with the gasket 44 to shut the passage 45 to the output line 46 leading the gas to the five-way valve 39; said shutter, counteracted by its spring, is moved to open the passage 45 for the gas by the rod 47; the tight sealing of the rod 47 is ensured by the gasket 48; inside the regulator body 40, the chamber 49 is pivoted, into which the beer comes, which is going to leave the pump through the duct 51; the chamber 49 is tightly sealed by the membrane 52 fastened by the cover 53, with said membrane 52 bearing the integral thrust and support element 54; on said membrane, on the opposite side relatively to the chamber 49, the spring 55 acts, the load of which which is adjusted by means of the screw 56.

In case the adjustment screw 56 is totally released, and therefore the spring does not apply any loads, no pressure will exist inside the chambers 33 and 34; the beer coming from the drum will enter both chambers 15 and 16 and will then exit them, and continue to run under its pushing pressure towards the pouring out stopcock; said condition will last until the load applied by the spring 55 will be lower than, or equal to, the force generated by the pressure of beer multiplied by the surface area of the membrane; when said load will exceed this force, the thrust element 54, by acting on the piston 47, will open the passage 46 for the gas which, through the five-way valve 39, will reach the chamber 33; at that time, the pressure inside the chamber 15 will increase, the valve 11 will consequently close, and the ball 19 will shut the passage in gasket 21 by going to rest against the gasket 21; the beer will enter, under the pressure by which it is delivered, the chamber 16, acting on the piston 26; therefore, the beer inside the chamber 15, beyond the efficiencies of the system, will be submitted to a thrust equal to the sum of the pressure of beer entering the chamber 16, plus the thrust generated by the gas inside the chamber 33; therefore, inside the outlet line 50, the pressure of the beer will increase, until inside the chamber 49 of the regulator 40 the new pressure of equilibrium with the calibration of the spring will be established; and therefore, the gas passage 46 will be choked; the larger or lower demand for beer will respectively increase, or decrease, the above indicated phenomenon.

The closure of the delivery stopcock will cause a condition to occur, in which beer, by now stationary, will apply a static pressure, with the pump operation being automatically discontinued; when the piston, in its leftwards stroke, viewing the diagram as shown in the hereto attached figure, will come to act on the sensor 36, thus opening the pressure passage through the valve 38 to the line 57, in order to drive the shuttle of the valve 39 to reach its other position, the chamber 33 will be turned into its discharge condition, and the modulated pressure will be delivered to the chamber 34; the chamber 16, by now full of beer, will become the delivery chamber, and the chamber 15 will start acting as the intake chamber; the inlet and outlet valves will invert their position, and the cycle will be started again.

It is clear from the above disclosure that, beyond the losses caused by the efficiency of the system, the pressure of the beer is the sum of the thrust pressure plus the pressure modulated with a gas consumption, which becomes practically equivalent to the pressure which one would have, if the pressure necessary for the delivery would be applied to the drum.

With a predetermined calibration of the value of the force of the spring 55, it is clear as well that for pressure changes inside the drum due to the adjustment in thrust carried out in order to preserve the ideal conditions of saturation, a gearing will automatically take place, with the thrust generated by the modulated pressure being varied; and, then, in case the pressure inside the drum is higher than the beer pressure calibrated by acting on the spring, a modulated thrust will not be present, and the pump will remain stationary. Such considerations bring into evidence the great advantages of the present invention, in that the pump is completely automatic, with an only pneumatic drive, therefore with the exclusion of any electrical drives or electronic control means, always delicate in such humid environments as the cellars are, with a gas consumption practically equal to the consumption experienced in the devices of the prior art, but with the great advantage that beer is maintained under ideal conditions.

Details for system improvement are then the introduction of the possibility of dismantling the cylinder and the regulator cover, without any special tools, in order to make possible a careful cleaning of all passages for beer to be carried out; and the possibility of manufacturing the whole system as one single block, with the direct provision of the pneumatic valves, which can be of the slide-valve type, or of the slider-on-ceramic type, wherein no need for lubricating moving members exists.

The disclosure has been made for a pump in which the liquid is contained inside the chambers towards the central body, and the gas is contained inside the external chambers, but reversing said roles does not limit the general scope of the invention in any way.

Furthermore, the hereinabove disclosure in detail has been always referred to beer, but, as above said, the pump can be applied to transfer facilities for delivering any types of liquids, and, in particular, of carbonated beverages.

We claim:

1. A pump for transferring pressurized liquids, in particular for beer or carbonated beverages comprising:

a central body having a rod reciprocable through said central body; first and second mutually opposite pistons on said rod, which pistons reciprocate integrally; said pistons sliding inside first and second cylinders, respectively, on opposite sides of said central body, whereby said pistons define, with their reciprocating motion, four variable-volume chambers, with a first and a second such chamber being located in said first cylinder on opposite sides of said first piston and with a third and a fourth such chamber being located in said second cylinder on opposite sides of said second piston; each of said first and third chambers having a liquid inlet and a liquid outlet; liquid being intaken alternately into said first and third chambers through said inlet through first valve means, said liquid being delivered alternately from said third and first chambers through said outlet under control of said first valve means; said delivered liquid being delivered alternately from said first and third chambers by a gas alternatively flowing into said second and fourth chambers respectively; a gas pressure regulator which modulates gas pressure in said second and fourth chambers and wherein pressure of the delivered liquid counteracts a calibration force in said gas pressure regulator, said gas alternatively acting, by control means inside of said second and fourth chambers to maintain a substantially constant and predetermined delivery pressure of said liquid and whereby said delivery pressure of said delivered liquid from one of said first or third chambers is obtained as the sum of a thrust exerted by liquid intaken in the other of said first or third chambers, plus the modulated gas pressure acting as a thrust on a face of the piston in said second or fourth chamber.

2. A pump according to claim 1 wherein the pressure regulator is provided with a regulator chamber inside which the delivered liquid from the liquid outlet of said first or third chamber flows, said regulator chamber being closed by a membrane counteracted by a force of a predetermined pressure applied by a force applying means such that when this force is greater than the pressure of the delivered liquid in the regulator chamber said force applying means acts through the membrane upon opening means in said regulator to open and modulate a gas passage in said regulator for gas so that the pressure of the gas in the regulator is applied, through second valve means, to act on the face of the piston in said second or fourth chamber respectively to add to the gas pressure thrust acting on said face of said piston.

3. A pump according to claim 2 wherein the mutually opposite pistons define, by means of inner faces of said pistons facing each other, said first and third chambers having liquid inlets and liquid outlets, and define, by means of outer faces of said pistons, said third and fourth chambers as gas thrust chambers; said central body provided with a single liquid intake conduit for intake of liquid to the liquid inlets of both the first and third chambers and a single liquid delivery conduit for delivery of liquid from the liquid outlets of both the first and third chambers.

4. A pump according to claim 2 wherein the second valve means comprises a gas distribution valve and said second and fourth chambers are each provided with sensor means which control said gas distribution valve to produce transfer of gas from the regulator to act on an outer face of the piston in one of the second or fourth chamber to produce reversal of the direction of the gas pressure thrust on said pistons and wherein said sensor means in said chambers are actuated, to produce said transfer of gas by a face of the piston in said chamber upon the piston reaching the limit of the reciprocating motion in said chamber.

5. A pump according to claim 4 wherein said sensor means comprises three-way pneumatic valves which control the gas distribution valve which is a bistable five-way distribution valve.

6. A pump according to claim 5 wherein all said valves are provided in a single device in which pneumatic conduits are provided, so that to pump the liquid only one gas delivery pipe and one gas discharge pipe, and liquid inlet pipe and liquid delivery pipe are connected to said device.

* * * * *